US006088972A

United States Patent [19]

Johanneck

[11] Patent Number: 6,088,972

[45] Date of Patent: Jul. 18, 2000

[54] CONCRETE FLOOR INSERT

[76] Inventor: Richard G. Johanneck, 62824-250th St., Litchfield, Minn. 55355

[21] Appl. No.: 09/172,880

[22] Filed: Oct. 15, 1998

[51] Int. Cl.[7] ..... E04G 15/00

[52] U.S. Cl. ..... 52/100; 52/220.8; 285/4; 285/56

[58] Field of Search ..... 52/100, 220.8; 249/39, 89; 285/3, 4, 56, 64; 454/270, 271, 243

[56] References Cited

U.S. PATENT DOCUMENTS

| | | | |
|---|---|---|---|
| 3,294,358 | 12/1966 | Hagedorn | 249/175 |
| 3,346,230 | 10/1967 | Tolf, Jr. | 249/177 |
| 4,026,511 | 5/1977 | Diener | 249/62 |
| 4,170,853 | 10/1979 | Kohaut | 52/99 |
| 4,261,598 | 4/1981 | Cornwall | 285/56 |
| 4,589,624 | 5/1986 | Jones | 249/39 |
| 4,619,084 | 10/1986 | Snitman | 52/182 |
| 4,619,087 | 10/1986 | Harbeke | 52/220.8 |
| 4,623,170 | 11/1986 | Cornwall | 285/4 |
| 4,706,927 | 11/1987 | Lawall | 249/177 |
| 4,883,590 | 11/1989 | Papp | 210/164 |
| 5,072,911 | 12/1991 | Logsdon | 249/61 |
| 5,156,755 | 10/1992 | Cass | 249/177 |
| 5,182,885 | 2/1993 | Barton, Jr. | 52/98 |
| 5,444,947 | 8/1995 | Miller | 52/100 |
| 5,496,213 | 3/1996 | Miller | 454/271 |

*Primary Examiner*—Michael Safavi
*Attorney, Agent, or Firm*—Westman, Champlin & Kelly, P.A.

[57] ABSTRACT

A concrete floor insert includes a peripheral side wall and a breakaway mount. The peripheral side wall has an inner surface which is disposed between a top end and a bottom end. The breakaway mount is adapted to fasten to a floor form and coupled to the inner surface of the peripheral side wall through a weakened portion such that when the floor form is removed from the hardened floor, the breakaway mount separates from the inner surface at the weakened portion.

18 Claims, 5 Drawing Sheets

CONCRETE FLOOR INSERT

BACKGROUND OF THE INVENTION

The present invention relates to an insert for forming openings in concrete structures.

Concrete slabs, or floors are generally formed by casting or spreading a wet concrete mixture usually containing a hydraulic cement, aggregate and water onto a horizontally extending surface upon which the slab of concrete is to be located. The cast or spread mixture is worked or finished so as to remove pockets of entrained air and so as to obtain a desired surface configuration. The wet mixture is then allowed to harden or set to form the final slab or floor. This process becomes somewhat more complicated when it is desirable to locate holes which extend through such slabs or floors. Often, when holes are required to be formed into the concrete structure, the workers fabricating such a structure search out any convenient material at the job site which appears suitable to hold back the wet mixture from the locations where holes are desired. This situation is less than optimal in that the conveniently available makeshift insert may not be sized correctly, or otherwise optimally configured as a concrete floor insert.

Further, it may take job site workers an inordinate amount of time just to locate and construct such make shift inserts. Occasionally, the construction of the makeshift inserts has not been effective to adequately hold back "wet concrete" from an area where a hole is desired. Also, holes created by this type of expedient do not normally have a desired "smooth" or "clean cut" surface configuration.

Concrete floor inserts generally fall within one of two categories. The first category is that of inserts which are designed to be removed from the solidified concrete thereby leaving behind a smooth concrete hole. The second kind of floor insert is designed to remain in the solidified concrete sometimes providing a smoother interior surface than that of bare concrete. However, if a concrete insert is designed to remain in place after the concrete solidifies, it would be necessary to provide such a concrete insert for each hole desired. Most of the concrete floor inserts of the prior art are specifically designed for removal after concrete solidification due in part to cost savings realized through reuse. Thus, there exists a need to provide a permanently embeddable concrete floor insert which can be provided at low cost.

SUMMARY OF THE INVENTION

A concrete floor insert includes a peripheral side wall and a breakaway mount. The peripheral side wall has an inner surface which is disposed between a top end and a bottom end. The breakaway mount is adapted to fasten to a floor form and coupled to the inner surface of the peripheral side wall through a weakened portion such that when the floor form is removed from the hardened floor, the breakaway mount separates from the inner surface at the weakened portion.

DETAILED DESCRIPTION OF THE PREFERRED EMBODIMENTS

Figure 1:
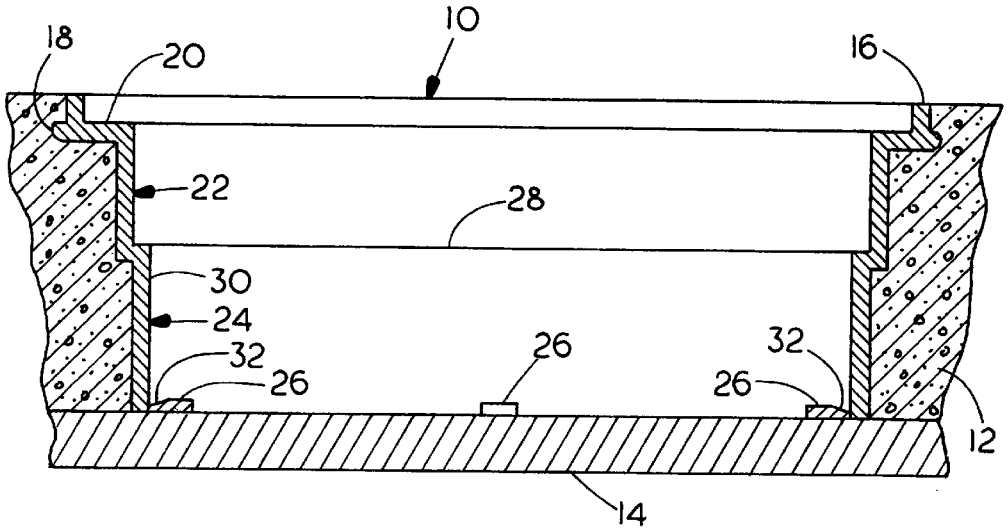
FIG. 1 is a cross section view of a concrete floor insert in accordance with the present invention.

FIG. 1 is a cross section view of concrete floor insert 10 in accordance with the present invention. Insert 10 is shown disposed within concrete floor 12 on top of floor form 14. Generally, when it is desirable to provide a vertical hole through floor 12, an insert such as concrete floor insert 10 is affixed to floor form 14 prior to pouring of the concrete. Then, as the poured concrete flows, it surrounds insert 10. In this manner, floor inserts such as floor insert 10 define each vertical hole through concrete floor 12. After concrete floor 12 hardens, floor form 14 is generally removed leaving behind only the hardened concrete floor.

As can be seen in FIG. 1, floor insert 10 is cylindrical and includes top rim 16, side lock rim 18, flange portion 20, first annular side wall 22, second annular sidewall 24, and break away mounts 26. It should be noted that although the present invention is described with respect to a cylindrical concrete floor insert, the present invention may be practiced equally with any suitable shape. Flange portion 20 extends laterally to top rim 16. Top rim 16 is preferably integral with flange portion 20, and extends upwardly therefrom. Side lock rim 18 is also preferably integral with flange portion 20 and extends laterally from flange portion 20. Thus, it can be seen that, side lock rim 18 extends laterally to such an extent that some concrete forming floor 12 is disposed directly above and directly below side lock rim 18. In this manner, side lock rim 18 acts to stabilize and lock concrete floor insert rim 10 into hardened concrete floor 12. As can further be seen, flange portion 20 also restricts movement of concrete floor insert 10 downwardly adding further stabilization.

First annular sidewall 22 is preferably integral with flange 20 and depends downwardly therefrom. Second annular sidewall 24 is preferably formed integral with first sidewall 22 and depends downwardly therefrom. As can be seen, second sidewall 24 is coupled to first sidewall 22 in such a manner so as to form a shoulder 28. Second sidewall 24 includes second sidewall inner surface 30 to which breakaway mounts 26 are coupled. Breakaway mounts 26 extend inwardly from second sidewall inner surface 30 and are adapted to couple concrete floor insert 10 to floor form 14 by screws, nails or any other appropriate means.

Breakaway mounts 26 each preferably couple to second sidewall inner surface 30 through a weakened portion. One example of such a weakened portion is tapered portion 32 which has a decreasing thickness as tapered portion 32 couples to second sidewall inner surface 30. By so configuring tapered portions 32, the weakest portion of breakaway mounts 26 is positioned proximate second sidewall inner surface 30.

Figure 2:
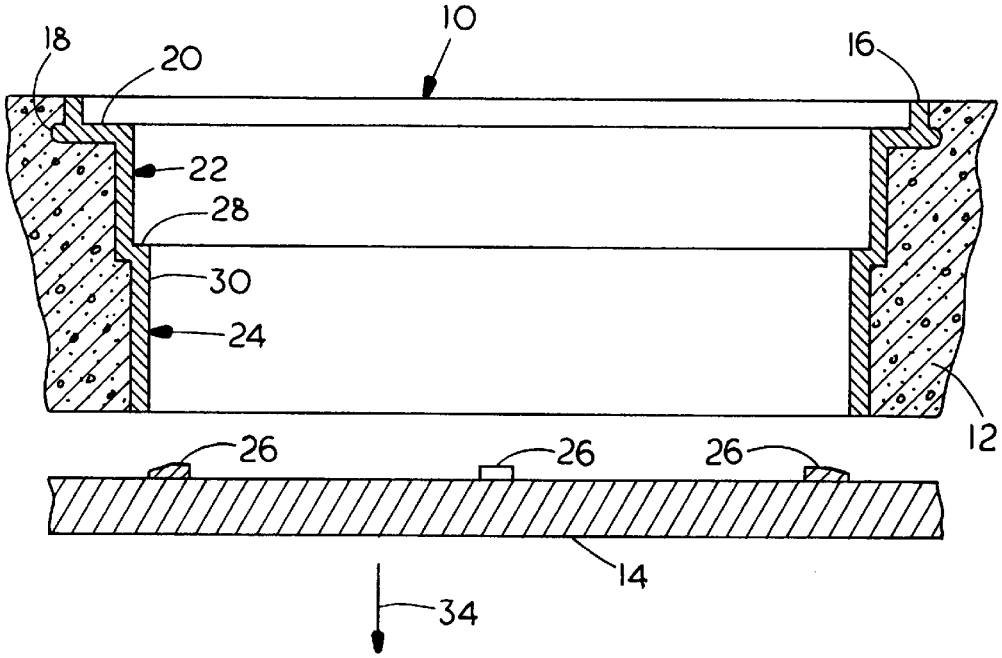
FIG. 2 is a cross section view of a concrete floor insert in accordance with FIG. 1 showing a form being removed.

FIG. 2 shows floor form 14 being removed from concrete floor 12 in the direction of arrow 34. Predictably, breakaway mounts 26 break apart from second sidewall inner surface 30 and follow floor form 14 due to their coupling thereto. Thus, concrete floor 12 remains after the removal of the floor form 14 having concrete floor insert 10 securely disposed therein.

Figure 3:
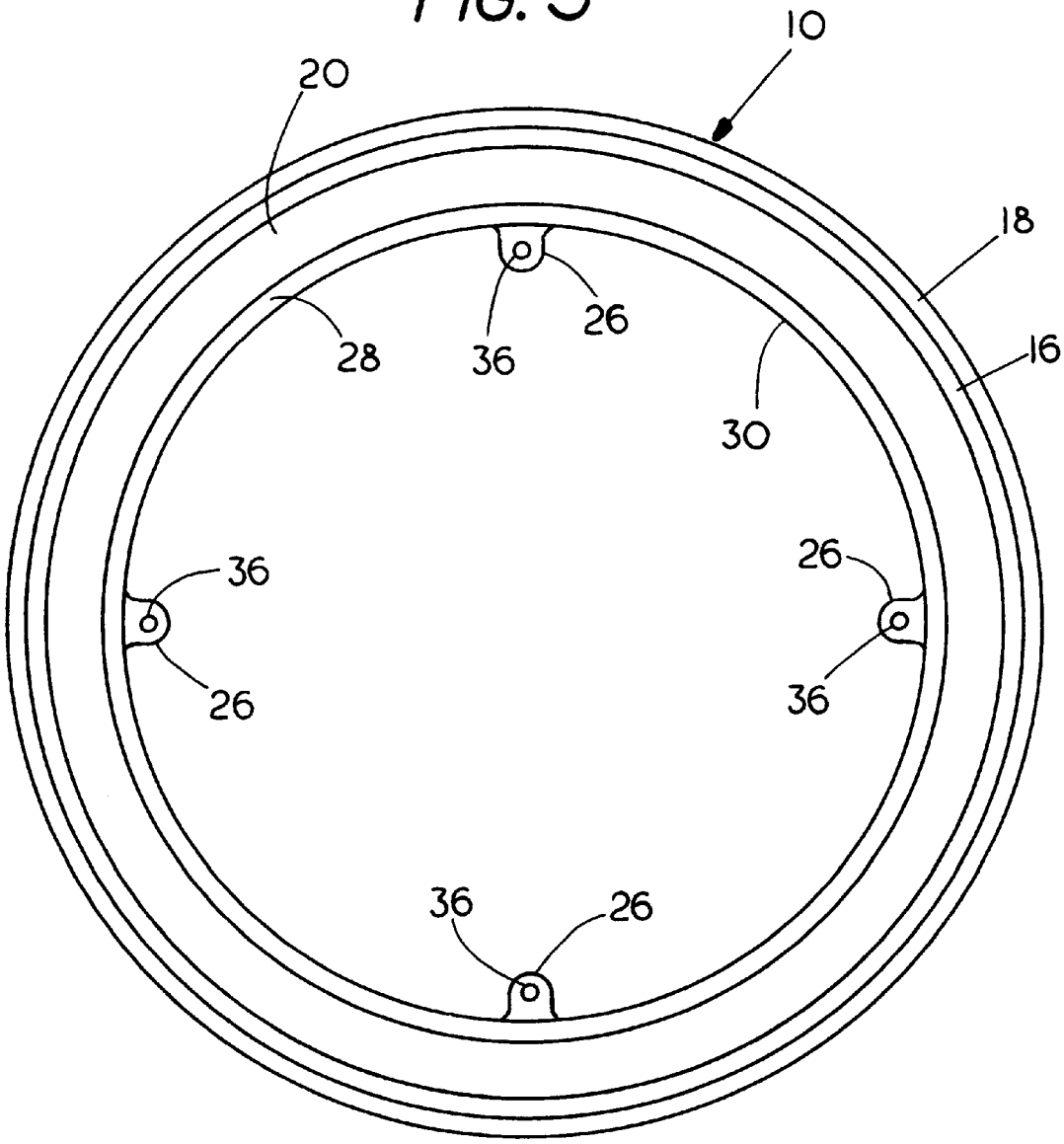
FIG. 3 is a top plan view of the concrete floor insert shown in FIG. 1.

FIG. 3 is a top plan view of concrete floor insert 10 in accordance with the present invention. As can be seen, concrete floor insert 10 is preferably ring shaped. However, as noted above, floor insert 10 may take any appropriate shape. In the preferred embodiment, side lock rim 18 continuously surrounds top rim 16 and flange portion 20. However, it is not necessary for side lock rim 18 to be continuous. Preferably, concrete floor insert 10 includes four breakaway mounts 26 which are disposed on second sidewall inner surface 30 and are spaced equally from one another. As can further be seen, each of breakaway mount tabs 26 includes a through hole 36 which facilitates mounting of breakaway mounts 26 to floor form 14 (shown in FIGS. 1 and 2).

Concrete floor insert 10 is preferably formed of an injection moldable plastic such that it may be mass produced at relatively low cost. More preferably, concrete floor insert 10 is formed of acrylonitrile-butadiene-styrene copolymer (ABS). However, if it is desirable to provide a through hole in a concrete floor in an environment in which floor temperatures would exceed maximum operating temperatures of the injection moldable plastic, the floor insert ring may be formed of any suitable materials such as aluminum or other metals.

Figure 4A:
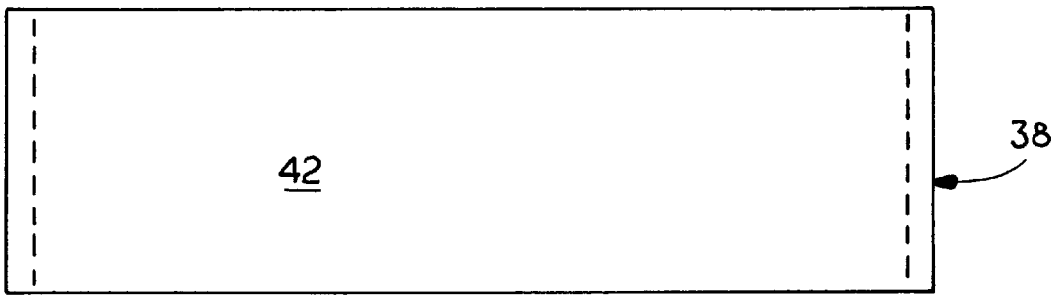
FIG. 4A is a side elevation view of an extension ring member made in accordance with the present invention.
Figure 4B:
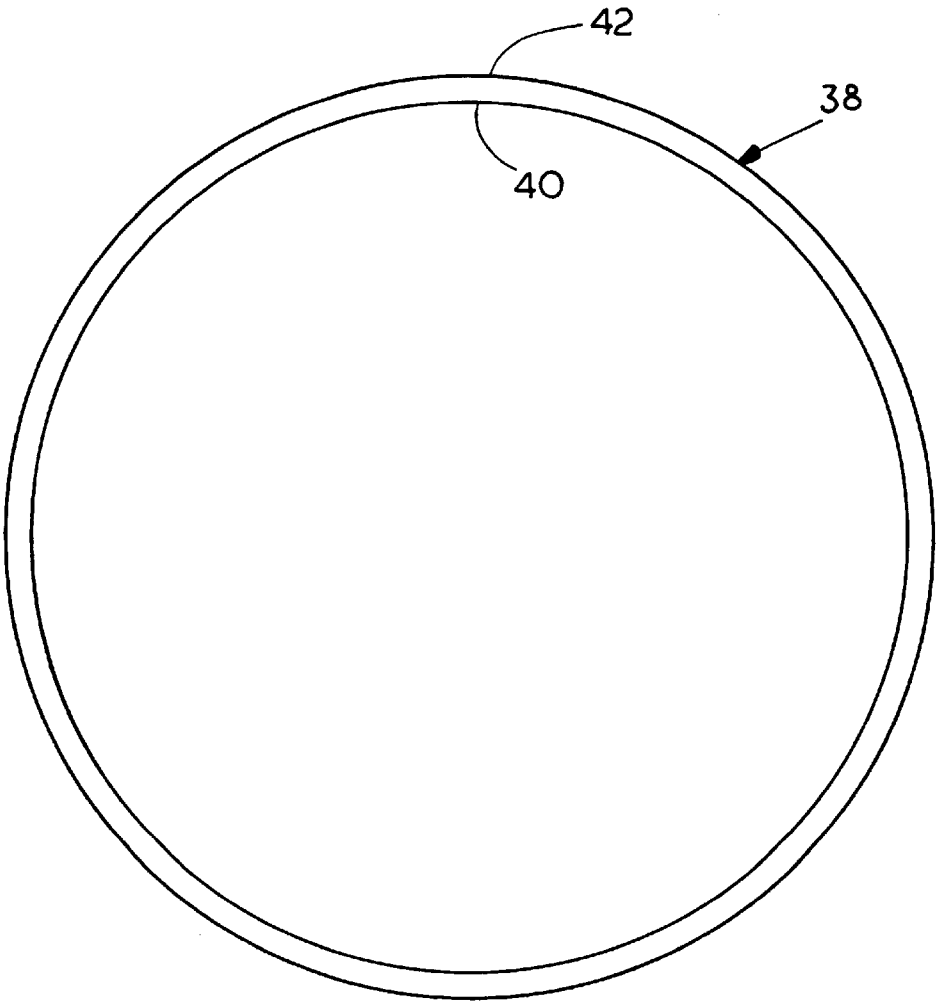
FIG. 4B is a top plan view of the extension ring member shown in FIG. 4A.

FIGS. 4A and 4B are elevation and top plan views, respectively, of an extension member 38 made in accordance with the present invention. Extension member 38 includes inner sidewall 40 and outer sidewall 42. Extension member 38 is shaped similarly to concrete floor insert 10 and sized such that outer sidewall 42 may be snugly fit within top rim 16 of floor insert 10 and thus to rest on flange 20 (shown in FIGS. 1–3). Those skilled in the art will appreciate that when extension member 38 is so configured with floor insert 10, a relatively simple apparatus is provided which ensures that water or the like which may be present on top of the solidifying concrete floor will not seep through or into concrete floor insert 10.

Figure 5A:
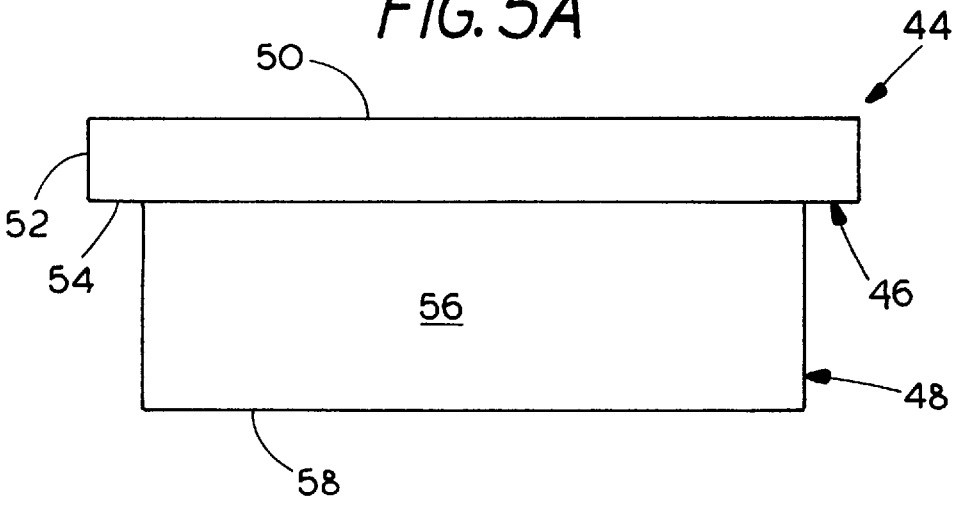
FIG. 5A is a side elevation view of a ring cover made in accordance with the present invention.
Figure 5B:
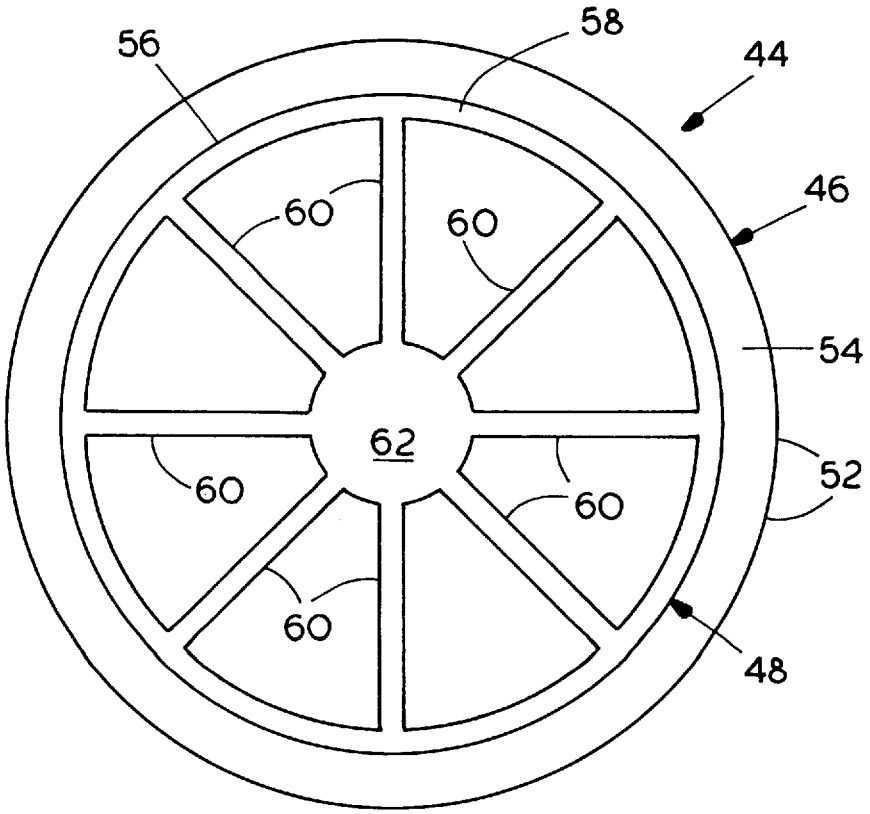
FIG. 5B is a bottom plan view of the cover shown in FIG. 5A.

FIGS. 5A and 5B are elevation and bottom plan views, respectively, of cover 44 in accordance with the present invention. Cover 44 includes cap 46 and support portion 48. Cap 46 includes top 50, peripheral sidewall 52 and bottom surface 54. Cap 50 of cover 44 is sized such that peripheral sidewall 52 fits within top rim 16 of concrete floor insert 10 (shown in FIGS. 1–3) and thus rests on flange 20 as the support portion 49 slides into the opening formed by first sidewall 22. Cover 44 is preferably formed of the same material as concrete floor insert 10 and extension member 38. Cover 44 covers concrete floor insert 10 during the fabrication of concrete floor 12, and remains there until the hole provided by concrete floor insert 10 is to be used. Thus, cover 44 may prevent job site workers from stepping into concrete floor insert 10 and potentially incurring injury.

Support portion 48 includes support sidewall 56 and bottom rim 58. Support sidewall 56 of support portion 48 is sized to slidably fit within first sidewall 22 of concrete floor insert 10. Further, the height of support sidewall 56 is selected such that when bottom surface 54 of cap 46 contacts flange portion 20 of concrete floor insert 10, bottom surface 54 of support portion 48 simultaneously contacts shoulder 28 of concrete floor insert 10. This configuration bolsters the ability of cover 44 to support load thereon. Support portion 48 also includes spokes 60 which are coupled to and extend from bottom surface 54 of cap 46. Further, spokes 60 couple support sidewall 56 to hub 62. In this manner, spokes 60 increase the load bearing ability of cover 44 without requiring significantly more material. Thus, cover 44 may be inexpensively injection molded and still provide some load support.

Figure 6:
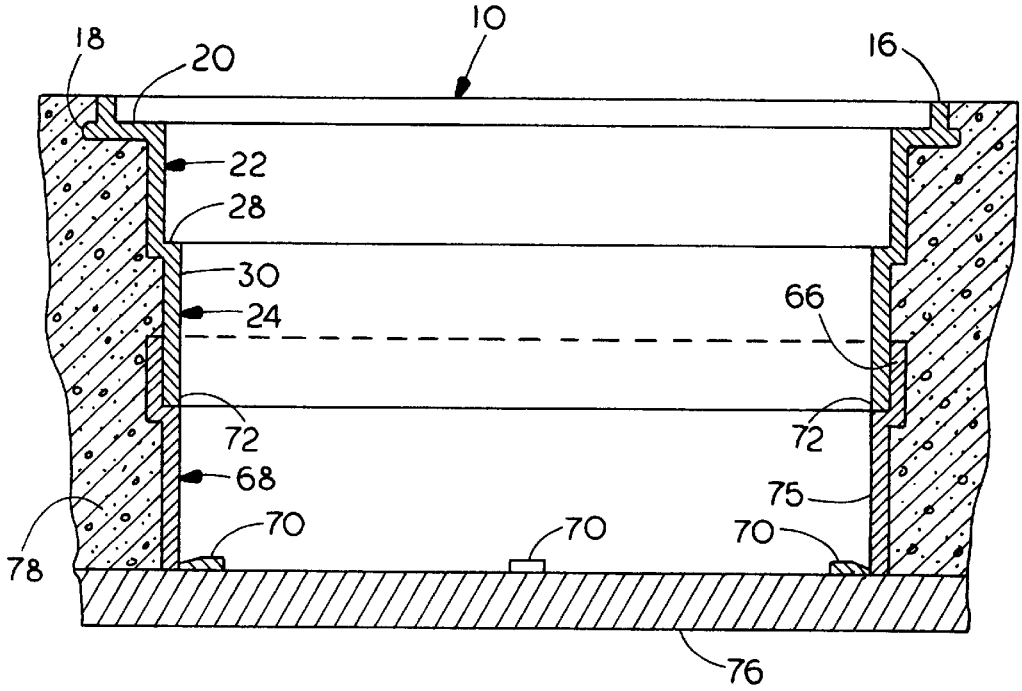
FIG. 6 is a cross section view of a concrete floor insert made in accordance with an alternate embodiment of the present invention.

FIG. 6 is cross section view of a concrete floor insert in accordance with an alternative embodiment of the present invention showing use of an extension ring insert mated with the concrete floor insert 10 of FIGS. 1 and 2. The concrete floor insert of FIG. 1 has the breakaway mounts broken away to provide a smooth inside surface and it is placed onto a concrete floor extension ring insert 64 which includes top rim 66, sidewall 68, and breakaway mounts 70. As can be seen, the wall 24 of concrete floor insert 10 fits inside the top rim 66 and can rest on a shoulder 72 formed where rim 66 ends and joins sidewall 68. The interior surface 75 of sidewall 68 aligns with interior surface 30. Extension ring insert 64 is similar to concrete floor insert 10 in that breakaway mounts 70 are identical to breakaway mounts 26. The breakaway mounts are described with respect to FIGS. 1–3 and removed when the extension ring insert is used.

In the embodiment shown in FIG. 6, the extension ring insert is used where a thicker floor 78 is desired. The assembly 10 and extension ring insert 64 slip together easily and provide the desired liner. When floor form 76 is removed, breakaway mounts 70 are separated from sidewall 68 in the mariner shown in FIG. 2.

Figure 7:
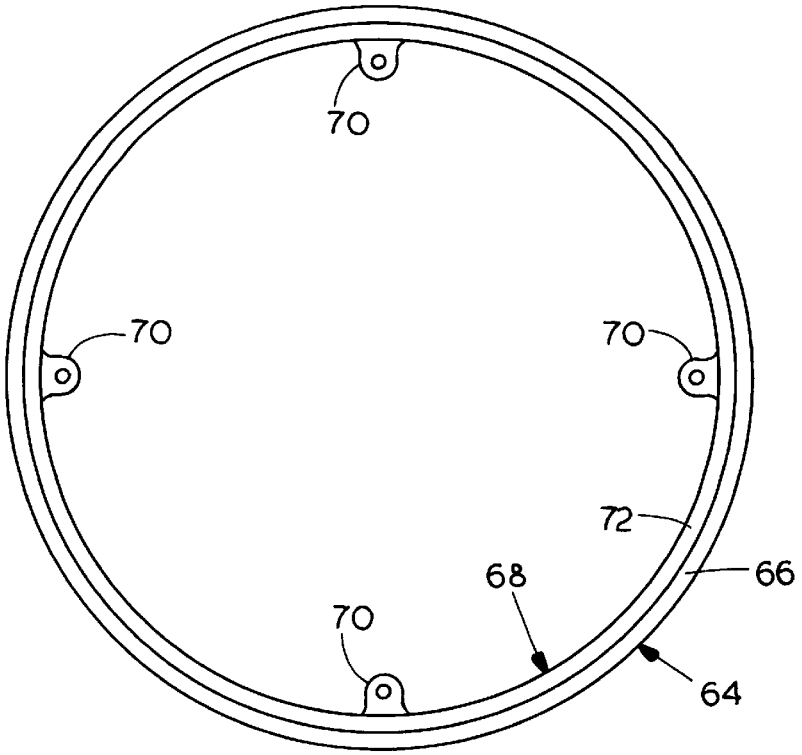
FIG. 7 is a top plan view of the concrete floor insert shown in FIG. 6.

FIG. 7 is a top plan view of concrete floor extension ring insert 64 in accordance with the alternative embodiment of the present invention removed from the insert 10. As can be seen, concrete floor insert 64 is ring-shaped and includes four breakaway mounts 70. Although the invention is described with respect to four breakaway mounts spaced peripherally equidistant from one another within sidewall 68, the invention may be practiced with any number of breakaway mounts. In fact, it would even be possible to provide an entire surface which could be coupled to a floor form and attached to sidewall 68 through a weakened portion such that when the floor form is removed the surface would sever at the weakened portion from sidewall 68. Thus, the present invention may even be practiced with one breakaway mount.

The axial length of rim 66 can be varied. AS shown, the wall 24 of insert 10 is seated on shoulder 75, but if a slightly thicker floor is desired the bottom edge of the wall 24 can be spaced upwardly from shoulder 75. One half inch or more of axial adjustment can be provided.

Although the present invention has been described with reference to preferred embodiments, workers skilled in the art will recognize that changes may be made in form and detail without departing from the spirit and scope of the invention.

What is claimed is:

1. A floor insert for a poured concrete floor which insert remains in place after concrete is poured comprising:

a peripheral sidewall having an inner surface disposed between a top end and a bottom end and an outer surface, the side wall defining an interior opening; and a breakaway mount adapted to fasten to a floor form, and coupled to the inner surface of the peripheral sidewall through a weakened portion, and protecting from the inner surface inwardly into the interior opening, the side wall being free of outwardly extending wall portions at the bottom end.

2. The floor insert of claim 1 and further comprising an upstanding rim disposed about the top end of the peripheral sidewall and coupled thereto.

3. The floor insert of claim 2 wherein the rim is formed integral with the peripheral sidewall.

4. The floor insert of claim 1 wherein the breakaway mount is formed integral with the peripheral sidewall.

5. The floor insert of claim 1, wherein the floor insert is constructed from acrylonitrile-butadiene-styrene copolymer.

6. The floor insert of claim 1, wherein the breakaway mount is coupled to the inner surface proximate the bottom end and has a bottom surface defining a plane including a bottom edge of the peripheral wall.

7. The floor insert of claim 1, wherein the floor insert has a circular shape.

8. The floor insert of claim 1, wherein the floor insert comprises:

an exterior insert ring having a rim at the top end offset from the inner surface;

a second floor insert having a peripheral sidewall having an inner surface disposed between a top end and a bottom end, the peripheral sidewall of the second floor insert slidably fitting within the rim.

9. The floor insert of claim 8 wherein the inner surface of the extension insert ring and the inner surface of the second insert are the same cross sectional size and shape.

10. A concrete floor insert comprising:

a first peripheral side wall having a first top end, a first bottom end, a first outer surface, and a first inner surface and defining an interior passage;

a second peripheral side wall having a second top end, a second bottom end, a second outer surface, and a second inner surface, the outer surface of the second peripheral side wall coupled to the inner surface of the first peripheral side wall proximate the first bottom end and the second top end;

a plurality of breakaway mounts extending from the second inner surface proximate the second bottom end and extending into the interior passage, the peripheral side wall being free of outwardly projections at the bottom end.

11. The concrete floor insert of claim 10 wherein the plurality of breakaway mounts comprises four breakaway mounts spaced peripherally equidistant from one another, the peripheral side wall outer surface being parallel to a central axis of the interior opening continuously to a bottom plane defining the bottom end, the break-away mounts having bottom surfaces on the bottom plane.

12. The concrete floor insert of claim 10 wherein the first and second peripheral side walls are formed integral with one another.

13. The concrete floor insert of claim 10 wherein the first peripheral side wall, second peripheral side wall, and break-away mounts are formed from acrylonitrile-butadiene-styrene copolymer.

14. The concrete floor insert of claim 10 and further comprising a laterally extending side lock rim disposed about and coupled to one of the first and second outer surfaces.

15. The concrete floor insert of claim 10 and further comprising a laterally extending flange portion disposed about and coupled to the first top end.

16. The concrete floor insert of claim 15 and further comprising a side lock rim disposed about and coupled to one of the flange portion, first outer surface, and second outer surface.

17. The concrete floor insert of claim 10 wherein the floor insert has a circular shape.

18. A concrete floor hole forming kit comprising:

a concrete floor insert including:

a peripheral side wall including an inner surface disposed between a top end and a bottom end and defining an interior passageway having a central axis, the outer surface of the peripheral wall extending parallel to the central axis adjacent the bottom end; and a breakaway mount adapted to fasten to a floor form, and coupled to the inner surface of the peripheral side wall through a weakened portion and projecting inwardly from the inner surface, the mount and the peripheral side wall terminating along a bottom plane, and the peripheral side wall being free of projections extending outwardly therefrom at the bottom end;

an extension member having a top end, and a bottom end adapted to substantially sealably engage the top end of the peripheral side wall; and a cover adapted to engage the top end of the extension member to thereby cover the extension member.

* * * * *